US005938241A

United States Patent [19]

Wilson

[11] Patent Number: 5,938,241

[45] Date of Patent: Aug. 17, 1999

[54] LOOSE-LEAF BINDER

[75] Inventor: Robert B. Wilson, South Hadley, Mass.

[73] Assignee: Specialty Loose Leaf, Inc., Holyoke, Mass.

[21] Appl. No.: 09/018,490

[22] Filed: Feb. 4, 1998

[51] Int. Cl.[6] ..... B42D 3/00

[52] U.S. Cl. ..... 281/36; 281/29; 281/21.1; 281/45; 402/73

[58] Field of Search ..... 281/15.1, 21.1, 281/28, 29, 36, 45, 46, 47; 402/70, 73, 76, 77

[56] References Cited

U.S. PATENT DOCUMENTS

| | | | |
|---|---|---|---|
| 449,858 | 2/1891 | Fletcher | 281/36 |
| 881,514 | 3/1908 | Wiedeman . | |
| 1,443,522 | 1/1923 | Buchan . | |
| 1,633,070 | 6/1927 | Crump . | |
| 1,644,625 | 10/1927 | Babian | 281/36 |
| 1,857,934 | 5/1932 | Blackburn . | |
| 2,109,646 | 3/1938 | Lotter | 281/36 |
| 3,252,462 | 5/1966 | Quarton et al. | 129/38 |
| 4,486,032 | 12/1984 | Leahy | 281/46 |
| 4,575,123 | 3/1986 | Giblin et al. | 281/48 |
| 4,934,738 | 6/1990 | Colonna | 281/28 |
| 5,037,137 | 8/1991 | Ozeki | 281/48 |
| 5,066,182 | 11/1991 | Stonebraker et al. | 412/3 |
| 5,078,425 | 1/1992 | Crudo | 281/21.1 |
| 5,533,236 | 7/1996 | Tseng | 24/67.5 |
| 5,636,869 | 6/1997 | Holmes | 281/45 |

*Primary Examiner*—Willmon Fridie, Jr.
*Attorney, Agent, or Firm*—Robert A. Seemann

[57] ABSTRACT

A plurality of U-shaped springs are hingedly attached by the arms of the U to a pair of covers forming a hinge on each cover and a channel configured to receive an article in the channel through the hinges.

16 Claims, 9 Drawing Sheets

LOOSE-LEAF BINDER

BACKGROUND OF THE INVENTION

1. Field of the Invention

The invention pertains to loose-leaf binders, more specifically to a loose-leaf binder of strong, inexpensive construction which temporarily binds papers in a resiliently biased spine.

2. Description of the Prior Art

FIGS. 1–4 show a prior art ringless spring-grip loose-leaf binder well known to the art and sold under various trade names, for example Avery Dennison model 96377 available in college book stores.

FIG. 1 is a front view of a prior art binder.

FIG. 2 is a perspective view of the binder of FIG. 1. A portion of one of the covers is cut away to show a construction of the binder.

FIG. 3 is a front view of the binder of FIG. 1 holding a booklet consisting of a quantity of loose paper sheets wrapped at one end by a flexible cover or folder.

FIG. 4 is a front view of the binder of FIG. 3 opened to release the booklet.

PRIOR ART binder 20 includes flexible longitudinal channel 21 forced closed by a plurality of circumferential U-shaped spring clips 33 along its length. Stiff covers 23 are attached by a pair of hinges 24 and 25 to the longitudinal edges 26 of the channel.

In FIG. 3, hinges 24 and 25 are biased toward one another by spring 33 and they clamp on folder 27 which extends into channel 21.

In FIG. 4, folder 27 is released from channel 21 and hinges 24 and 25 by folding covers 23 back around channel 21 and drawing them toward one another 28 which forces the hinges 24, 25 apart 29 by bending spring clip 33 apart about fulcrum 30.

Folder 27 is U-shaped, made of flexible paper or plastic, and is filled with sheets of paper 32. When the paper-holding folder is clamped between hinges 24 and 25 the part of each sheet of paper that is outside channel 21 is available for viewing.

Although the prior art binder serves the purpose for which it is intended, it is expensive and cumbersome to manufacture, requiring skilled hand labor to form the channel and to mount the spring clips around the channel. Opening the channel places great strain on the channel carcass by the spring, resulting in reduced operational life.

U.S. Pat. No. 1,443,522, patented Jan. 30, 1923 by H. G. Buchan describes a binder having two covers, and a plurality of U-shaped springs wrapped by a flexible binding that is wrapped over the ends of the legs of the U and fixedly clamped to the ends of the legs under a pair of longitudinal clamping tubes, each tube being split lengthwise. A length of binding extends from the split of each clamping tube and flexibly supports one of the two covers. Wedges are used to force the springs open so that elements of the binder can be assembled.

SUMMARY OF THE INVENTION

It is one object of the invention to provide a binder which is inexpensive to manufacture.

It is another object to provide a binder that places little stress on the carcass when the binder is being opened to install paper or an article in the binder.

It is another object that the binder clamping portion does not obscure written material adjacent to a margin of paper installed in the binder.

Other objects and advantages will become apparent to one reading the ensuing description of the invention.

A first pair of covers is attached by a first pair of hinges to a spine having a first channel adapted for receiving an item between the first pair of hinges, a U-shaped spring comprises a pair of arms and a bottom member connected to the arms forming the U, and a pair of wings are attached by a second pair of hinges to the ends of the arms of the U, one wing is mounted on one cover, the other wing is mounted on the other cover, the U-shaped spring includes a second channel adapted for receiving the item between the second pair of hinges, and the second channel is mounted within the first channel.

The wings are mounted slidingly on the covers.

The first pair of hinges are on different axis from the second pair of hinges.

Means for spacing the item from the bottom member is mounted in the U-shaped spring and is configured to place the bottom portion of the item between the second pair of hinges. Preferably it is a compressible bar.

In one arrangement of the invention, the compressible bar is mounted in a folder cover in the spring.

In another arrangement of the invention a binder has a first cover and a second cover, and comprises a plurality of U-shaped springs, each spring of the plurality of U-shaped springs has a top and a bottom member and includes a first arm which extends from the bottom member to the top and a second arm which extends from the bottom to the top, the top of the first arm and a first side of the first cover form a first sliding hinge, the top of the second arm and a first side of the second cover form a second sliding hinge, the bottoms, first arms, and the second arms form a first channel configured for receiving an item through the first and second hinges when the tops of the arms of the U-shaped springs are moved away from one another.

The plurality of first hinges are movable laterally to the first side of said first cover.

Means for spacing the item from the bottom member is mounted in the U-shaped spring and configured to place a bottom portion of the item between the second pair of hinge means.

In another arrangement of the invention a binder has a first cover and a second cover, and comprises a plurality of U-shaped springs, each of the plurality of U-shaped springs has a top and a bottom and includes a first arm extending from the bottom to the top and a second arm extending from the bottom to the top, the tops of the first arms and a first side of the first cover form a first sliding hinge, the tops of the second arms and a first side of the second cover form a second sliding hinge, the bottoms and the first arms and the second arms forming a first channel configured for receiving an item through the first and second hinges when the tops of the arms of the U-shaped springs are moved away from one another.

BRIEF DESCRIPTION OF THE DRAWINGS

In order that the invention be more fully comprehended, it will now be described, by way of example, with reference to the accompanying drawings, in which:

FIG. 5 is a top view of a binder according to the invention. The binder is laid open.

FIG. 6 is a cross section view of the binder of FIG. 5 taken along 6—6.

FIG. 7 is an end view of the binder of FIG. 6, open to receive paper.

FIG. 8 is a front view of another binder of the invention.

FIG. 9 is a front view of another binder of the invention.

FIG. 10 is a front view of the binder of FIG. 9.

FIG. 11 is a perspective view of elements of the binder of FIG. 9.

FIG. 12 is a front view of elements of the binder of FIG. 9.

FIG. 13 is a perspective view of an element of the binder of FIG. 9.

FIG. 14 is a perspective schematic view the binder of FIG. 9.

FIG. 15 is a front view of a binder of the invention.

FIG. 16 is a perspective view of an element of the binder of FIG. 15.

FIG. 17 is a front view of a binder of the invention.

DESCRIPTION OF THE PREFERRED EMBODIMENTS

Figure 1:
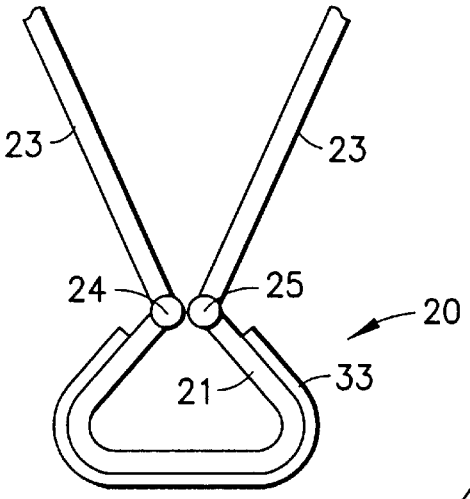
FIG.1 PRIOR ART
FIGS. 1–4 are views of PRIOR ART, explained supra.
Figure 2:
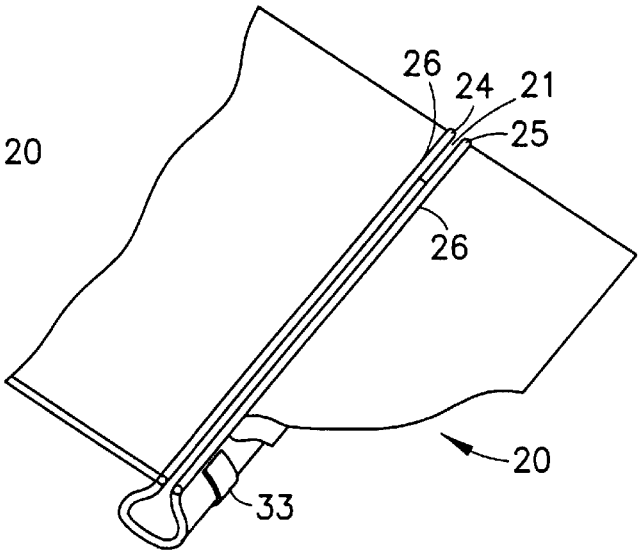
FIG.2 PRIOR ART
Figure 3:
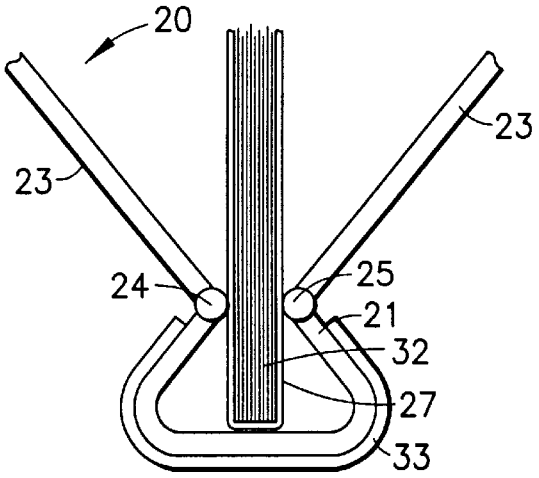
FIG.3 PRIOR ART
Figure 4:
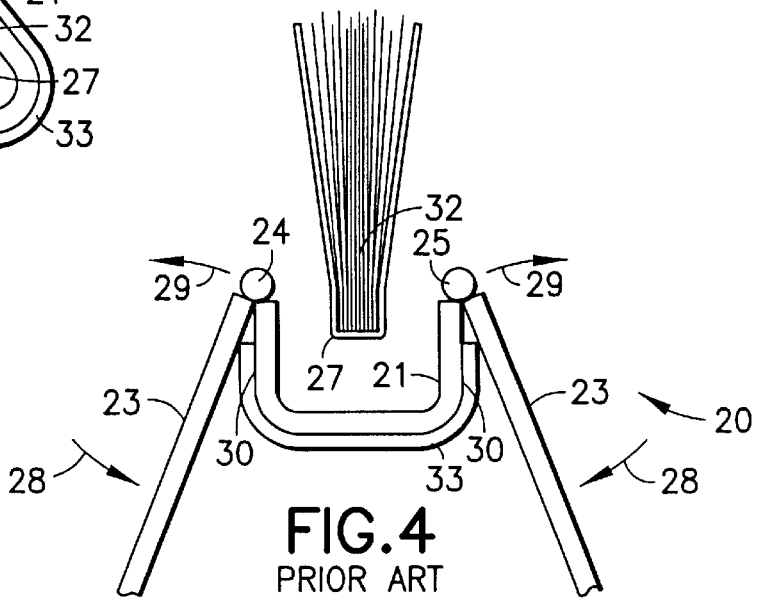
FIG.4 PRIOR ART

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Figure 5:
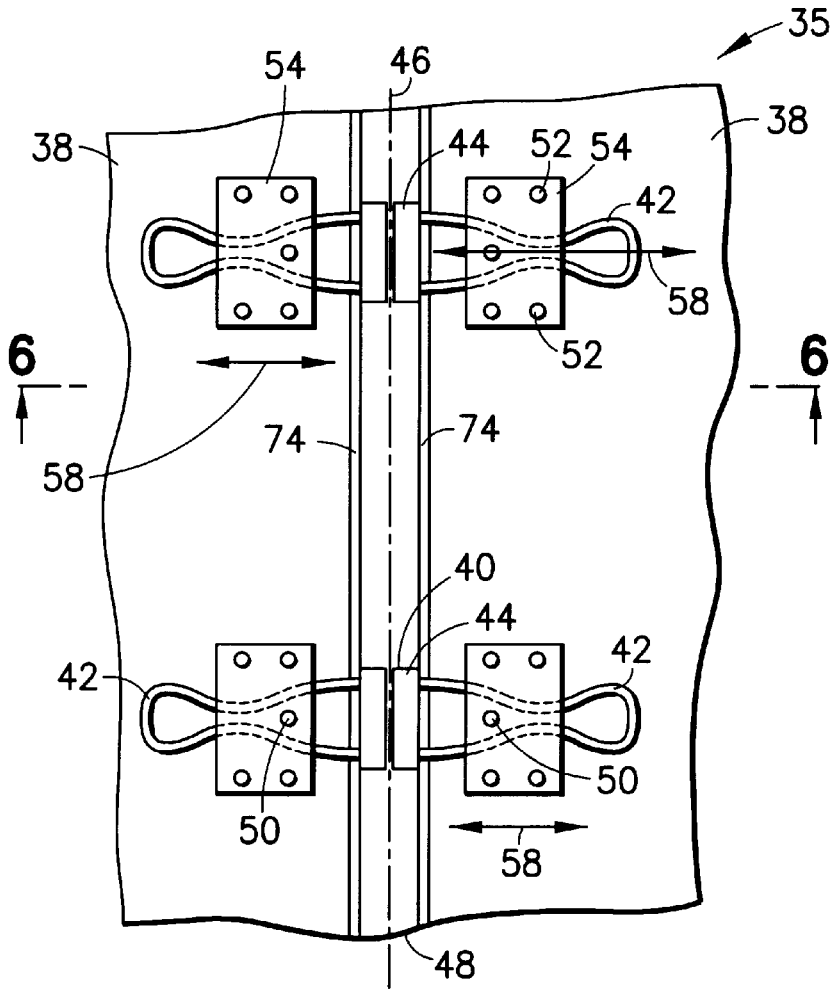
FIGS. 5–17 are views of the invention.
Figure 6:
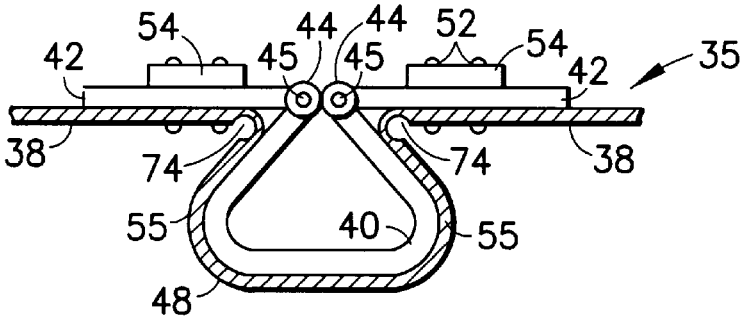
Figure 7:
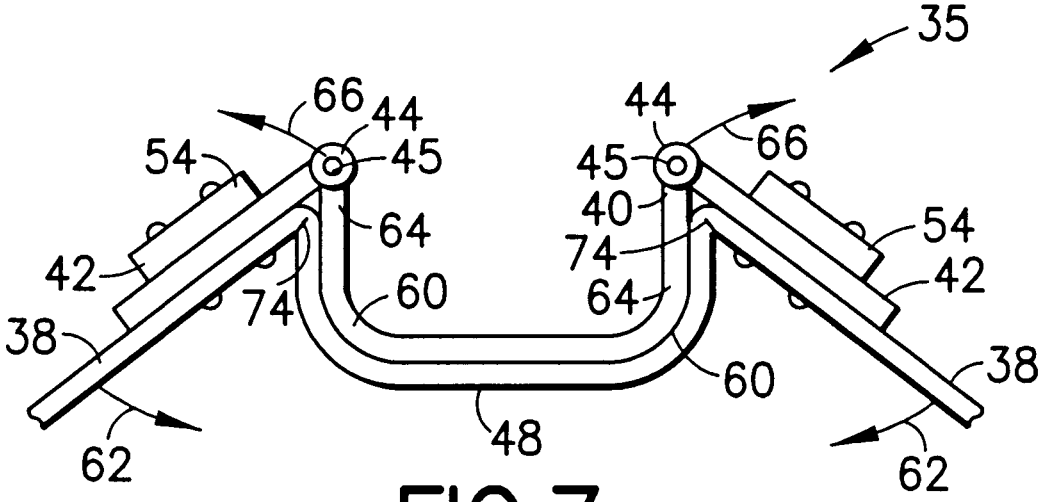

Referring to FIGS. 5–7, binder 35 covers 38 are stiff. Spring clip 40 has wings 42 attached by hinges 44 to sides 64 of the clip. A plurality of clips 40 are mounted along longitudinal axis 46 of spine 48 of binder 35.

The wings are mounted on the covers by plates 54 which are riveted 52 to the covers with enough yield to each wing so that each wing can slide between plate and cover laterally 58 to axis 46. Other fastening means than the plates may be used to slidingly attach the wings to the covers. For example lateral pockets may be provided within the covers to slidingly receive the wings. For another example, the wings may be slidingly held on the cover by transverse bars attached to the cover.

Preferably a stop 50 or lateral constriction is included on the fastening means to prevent removal of the wing from the cover. The wing can be rod, bar, looped wire, or other extension that can be hingedly mounted on the sides 64 of the spring clip.

Hinges 44 grip papers (not shown) between the hinges. The papers are inserted between hinges 44 when the hinges are drawn apart 66 (FIG. 7) by rotating covers 38 down against flexible sides 55 of spine 48 and squeezing toward one another 62 covers 38 so that the portions of the covers that are adjacent to hinge 44 draw apart 66 hinges 44 upon the fulcrum of covers 38 against the bottom 60 of sides 64 of the clip.

The covers rotate open and closed on longitudinal hinges 74 which may be paper, fabric, or plastic hinges, plastic living hinges, or engaging-loop hinges. Hinges 74 and hinges 44 are not on a common axis.

Each hinge 44 is a sliding-rotation hinge. It rotates by sliding coaxially on a member. Hinge 44 preferably slides on pin 45. Sliding hinge 44 may also be made without a pin by providing concentric coaxially sliding curved members or fingers.

Wings 42 slide laterally in two directions under plates 54 when the covers are rotated between closed and open.

During assembly of the binder, the spine is folded around the spring until the opening between the plates 54 and the cover is lined up with the wings, then the covers are slid together, sliding the wings under the plates. Stop 50 may be chamfered to permit the wing to slide in and to prevent removal of the wing.

Figure 8:
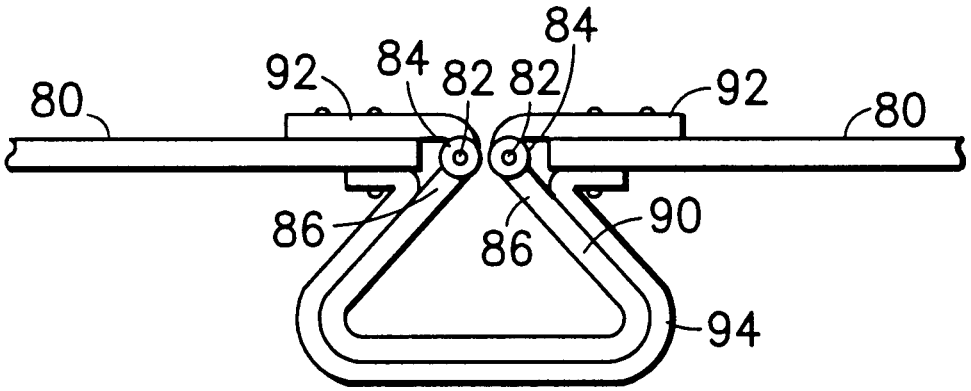

In another embodiment of the invention, shown in FIG. 8, the pair of covers 80 rotate on a pair of axis 82 of sliding-rotation hinges 84 at the ends of arms 86 of U-shaped spring body 90, by being fixedly attached to wings 92 which extend from the axis. Decorative flexible outer cover 94 is added to conceal the plurality of U shaped spring bodies from view when the binder is closed. An article, or paper, is gripped by hinges 84 which are moved apart by folding the covers down and toward one another as described for the embodiment of FIGS. 5–7.

Referring now to FIGS. 9–14 binder 110 hinge plates 114 and 116 are attached to covers 120 and 122 by anchor teeth 126 which are stamped outward from the surfaces of the hinge plates.

Covers 120 and 122 are connected together by flexible panel 130. Mounted on panel 130 are longitudinal spacer, stiffeners 132, 134, and 136 which are adjacent to and generally coincide respectively with sides 140 142 and 144 of each of the plurality of U-shaped metal springs 150 when the springs 150 are attached respectively to plates 114 and 116 by rods 154 and 156.

Spring 150 is preferably stamped from springy sheet material. It is preferably formed in a single piece.

The term "U-shaped" applied to the spring of the invention is defined herein to include the sides and bottom of the spring being in any combination; straight, curved, bowed, triangular, squared, or round, the shape of the spring being suitable to receive an item through the hinges when the hinges are moved apart.

Rod 154 extends through hinge loops 158 and 160 in a close rotatable sliding fit so that hinge loops 158 and 160 can rotate with respect to one another and form between them hinge 172.

Rod 156 extends through hinge loops 164 and 166 in a close rotatable sliding fit so that hinge loops 164 and 166 can rotate with respect to one another and form between them hinge 174.

Figure 9:
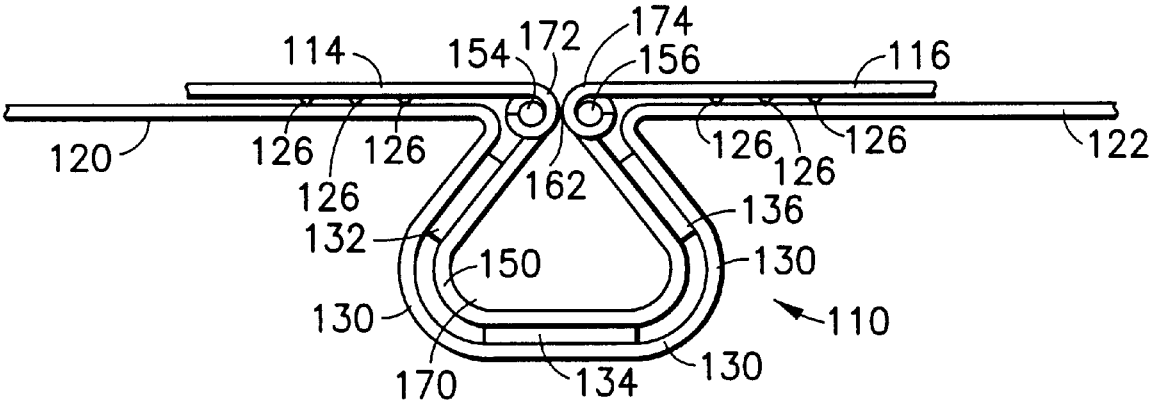
Figure 14:
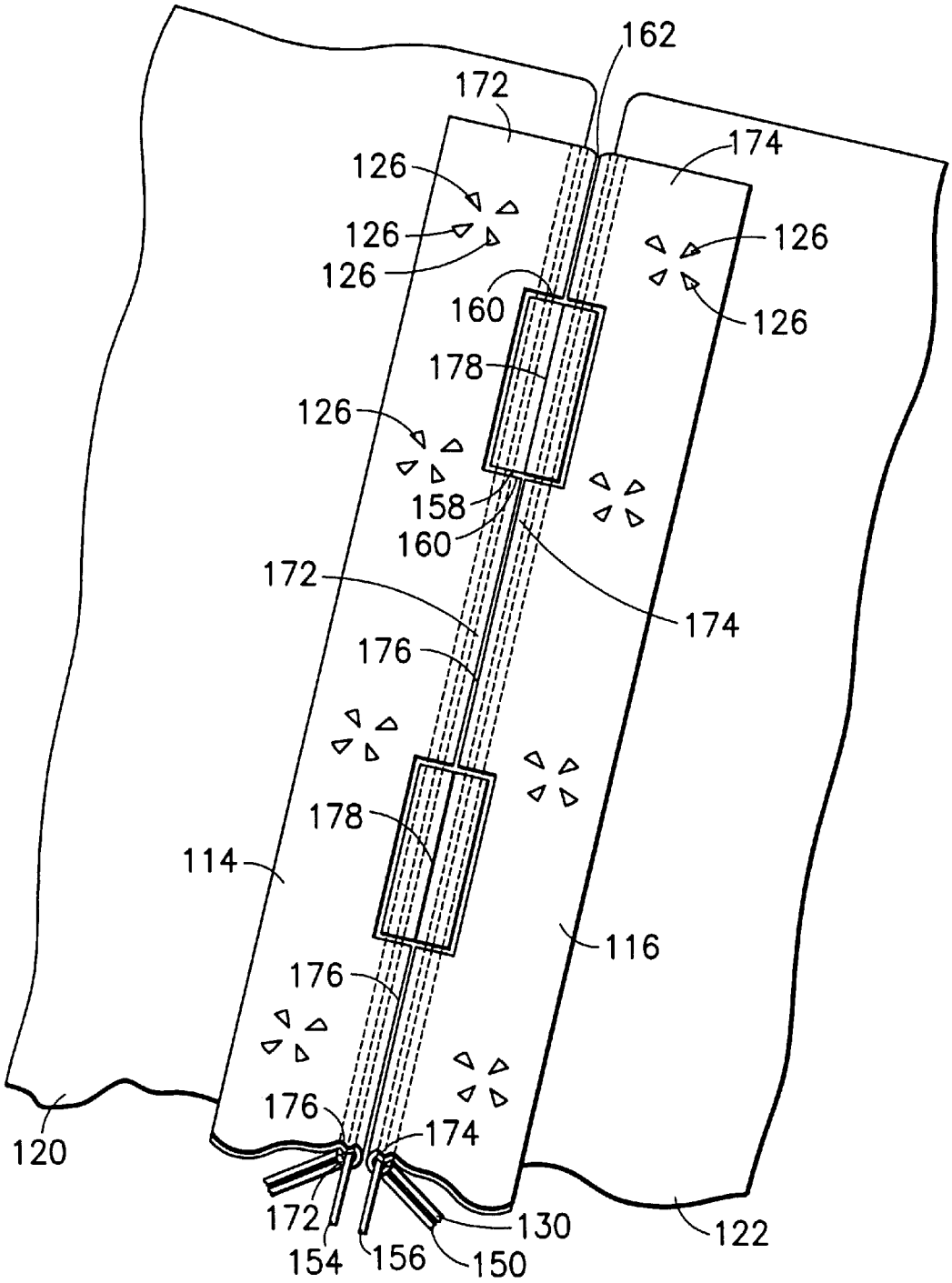

In FIGS. 9 and 14, longitudinal channel 170 is closed by hinges 172 and 174 being closely adjacent to one another, preferably touching one another along a pinch line 162, so that they are capable of clamping even a single thin sheet of paper between them.

The clamping face of hinge 172 includes longitudinal outer surfaces 176 and 178 respectively of plate 114 hinge loops 160 and of the plurality of springs 150.

The clamping faces of hinge 174 include longitudinal outer surfaces 182 and 184 respectively of plate 116 hinge loops 164 and of the plurality of springs 150.

Figure 10:
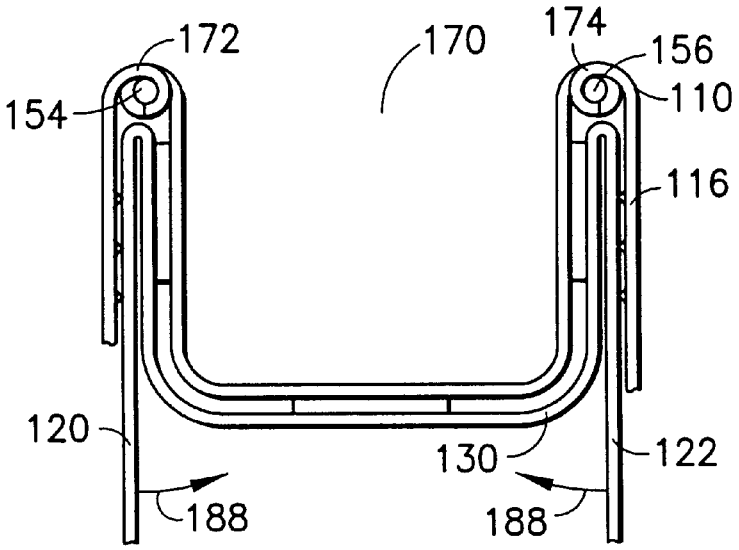
Figure 11:
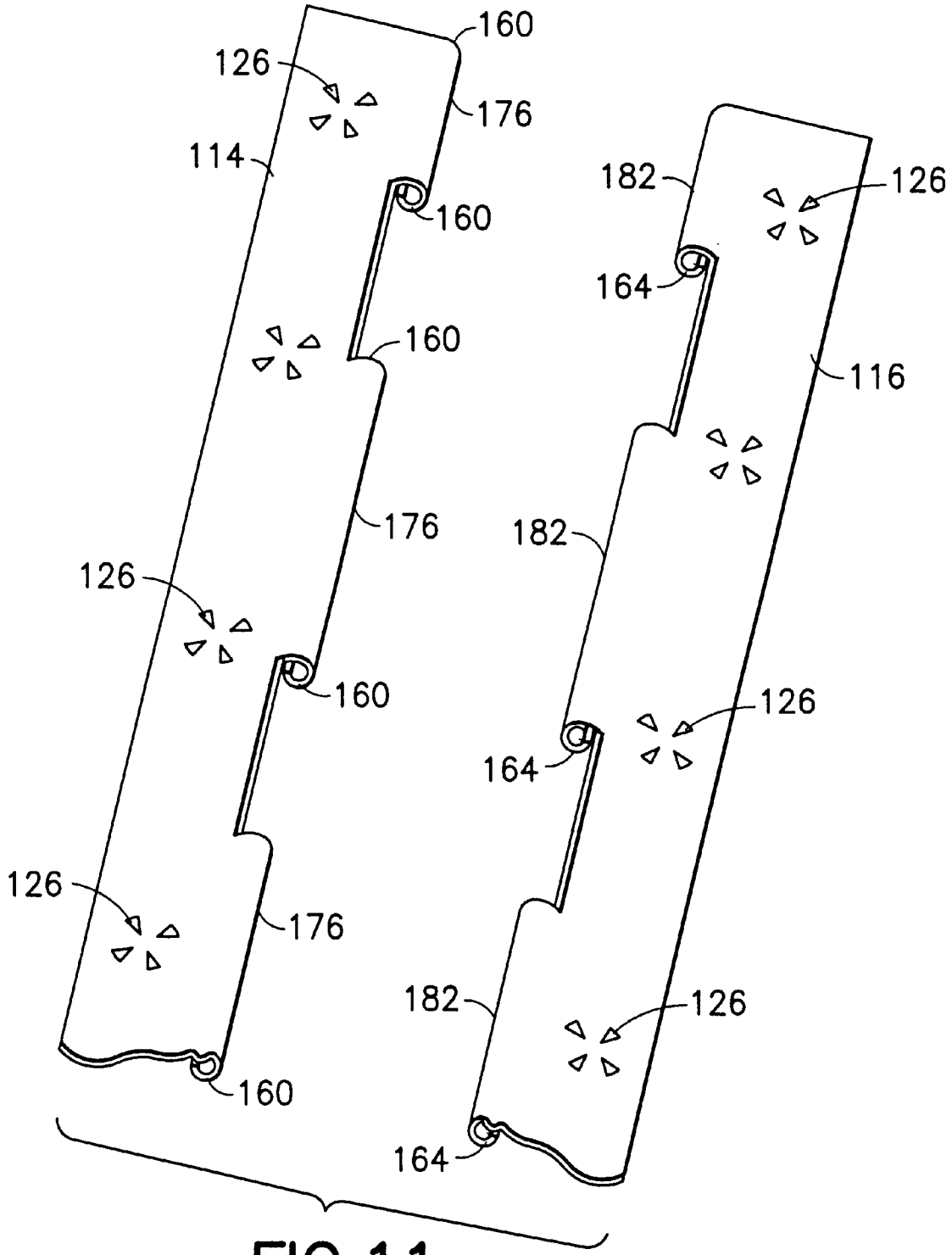
Figure 12:
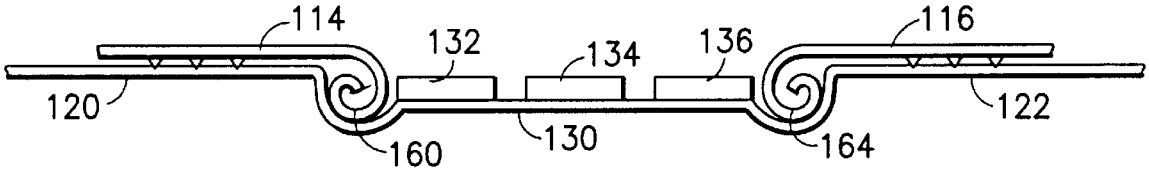
Figure 13:
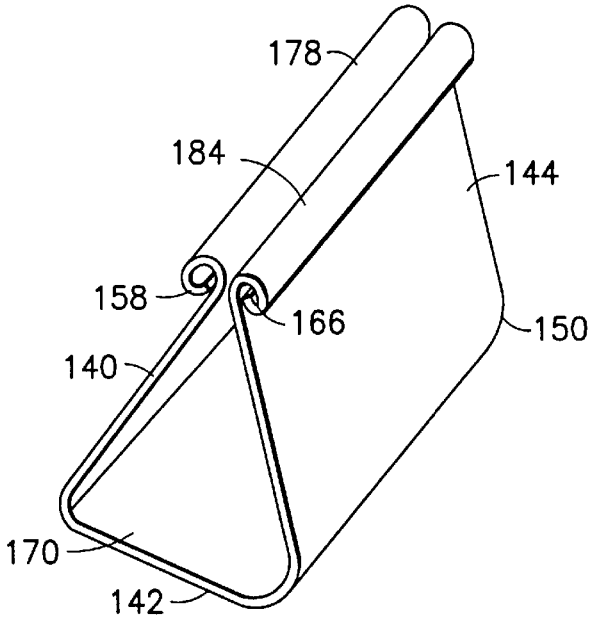

In FIG. 10, channel 170 is open to receive papers or other items for clamping between hinges 172 and 174. Channel 170 is opened by moving covers 120 and 122 toward one another 188 thereby moving apart separating hinges 172 and 174. Each cover can be rotated on the hinge out of the coplanar position, preferably above and below the coplanar position, and preferably to nearly parallel above the coplanar position, and to an angle below the coplanar position sufficiently to bias the hinges apart.

The binder is assembled inexpensively with little strain on the carcass by pressing plates 114 and 116 into the covers whereby they self anchor through teeth 126, place a spring on panel 130, and move the covers together until the hinge loops are generally concentric on a line, and insert rods 154 and 156 forming sliding-rotation hinges 172 and 174.

Figure 15:
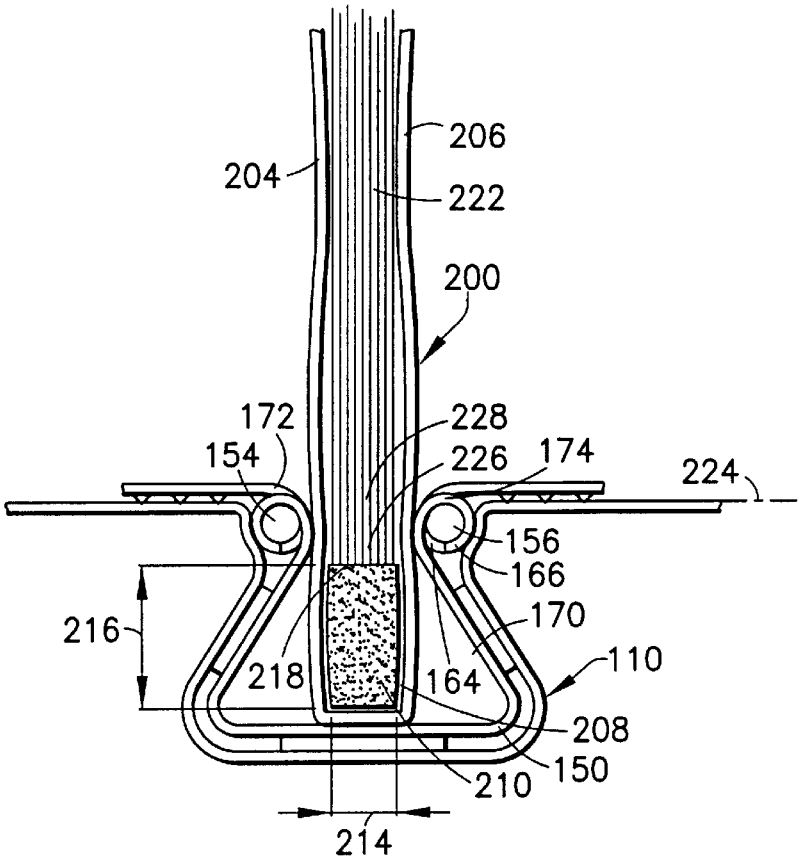
Figure 16:
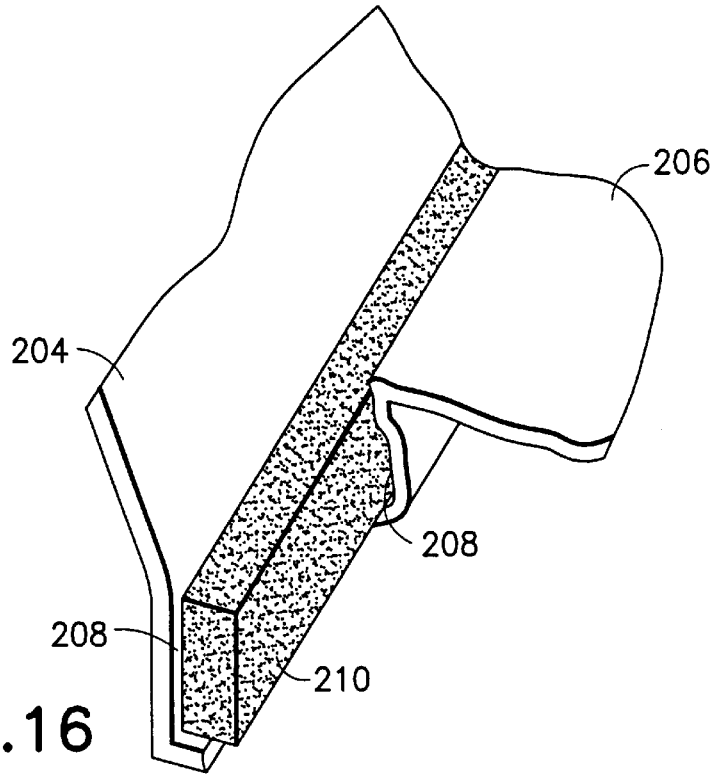

In FIGS. 15 and 16, folder 200 which is clamped in binder 110 includes flexible covers 204, 206 which are preferably attached 208 to compressible bar 210 which is preferably made of foam rubber or plastic. Attachment 208 may be by cement, pinning, or other suitable means. The compressibility of the foam bar permits covers 204 and 206 to be squeezed close to the foam bar and close to the ends of the papers, against a pack of paper which may not be as wide 214 as the foam bar. The resistance to deformation and height 216 of the foam bar is set to place the bottom 218 of the papers 222 within channel 170 and adjacent to pinch level 224 of hinges 172, 174. This places margin 226 which is adjacent to text on the papers at the pinch level, and places the text portion 228 of the papers outside of the pinch level and outside of the channel where it can be viewed by a user of binder 110. The pinch level generally coincides with a line passing through rods 154 and 156. It may, however be displaced by the shape of the hinge loops and is generally through the tangency of hinges 172 and 174 when the channel is closed, close to the level of the pinch line.

Figure 17:
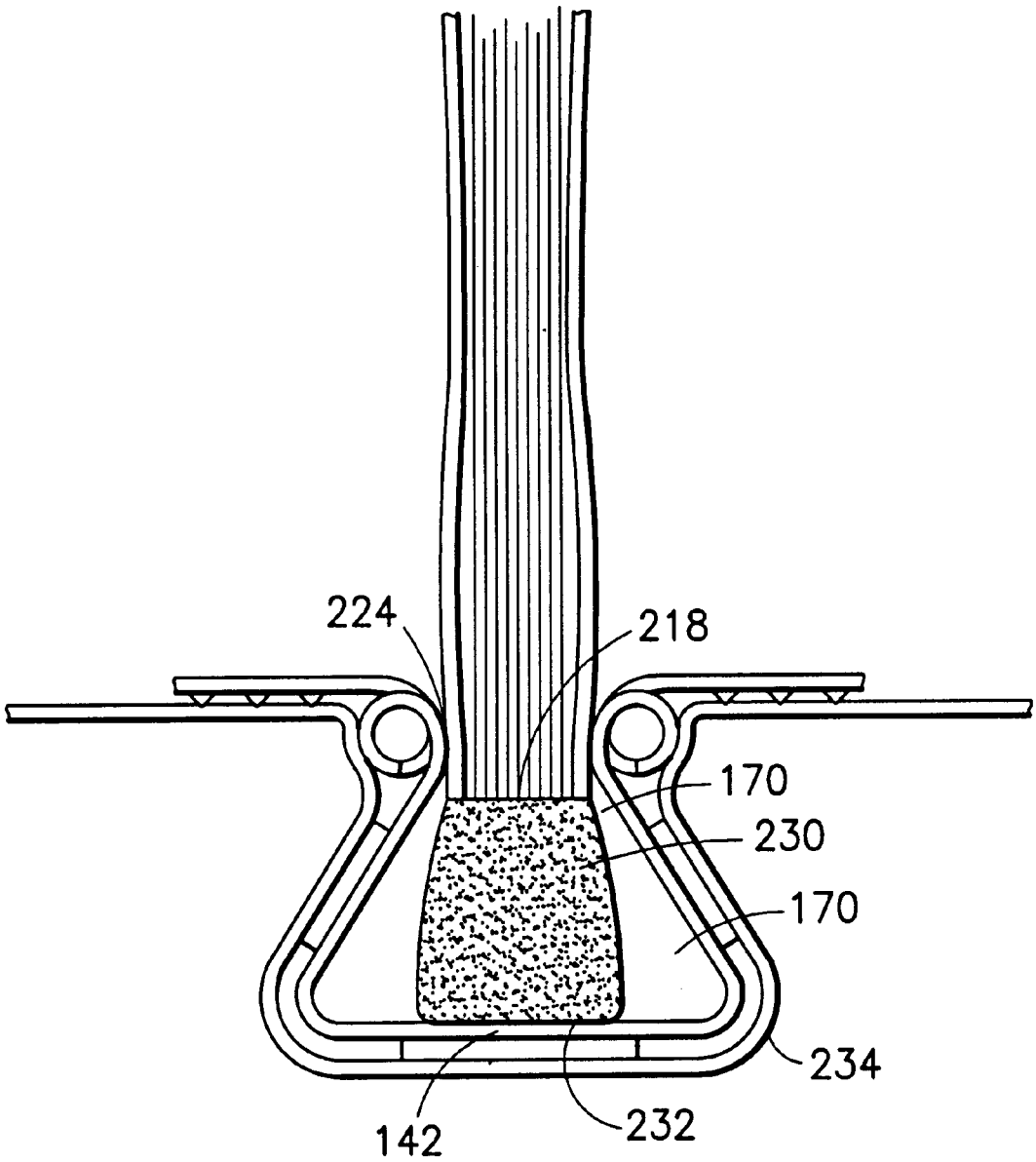

In FIG. 17, the arrangement of elements of binder 234 is similar to the arrangement of elements of binder 110 in FIG. 15, without covers 204 and 206. Compressible foam bar 230 which is attached 232 to panel 142, preferably by cement, places bottom 218 of the papers within channel 170 and at pinch level 224.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A binder comprising a first pair of covers attached by a first pair of hinge means to a spine having a first channel adapted for receiving an item between the first pair of hinge means, a U-shaped spring comprising a pair of arms and a bottom member connected to the arms forming the U, and a pair of wings attached by a second pair of hinge means to the ends of said arms of the U, one wing of said pair of wings being mounted on one cover of said first pair of covers, the other wing of said pair of wings being mounted on the other cover of said first pair of covers, said U-shaped spring comprising a second channel adapted for receiving said item between the second pair of hinge means, said second channel being mounted within said first channel.

2. The binder of claim 1 wherein said wings are mounted slidingly on said covers.

3. The binder of claim 1 wherein said first pair of hinge means are on different axis from the second pair of hinge means.

4. The binder of claim 3, wherein said wings are mounted slidingly on said covers.

5. The binder of claim 1, further comprising means for spacing the item from said bottom member, mounted in said U-shaped spring and being configured to place the bottom portion of said item between said second pair of hinge means.

6. The binder of claim 5 wherein said means for spacing the item from said bottom member is a compressible spacer.

7. The binder of claim 5 wherein said means for spacing the item from said bottom member is a compressible spacer mounted in a folder cover in the spring.

8. A binder comprising a first cover and a second cover, a plurality of U-shaped springs, each spring of said plurality of U-shaped springs having a top and a bottom member, and comprising a first arm extending from the bottom member to the top, and a second arm extending from the bottom member to the top, the top of the first arm and a first side of the first cover forming a first sliding-rotation hinge, the top of the second arm and a first side of the second cover forming a second sliding-rotation hinge, the bottom members, first arms, and the second arms forming a first channel configured for receiving an item through the first and second hinges when the tops of the arms of the U-shaped springs are moved away from one another.

9. The binder of claim 8, further comprising means for spacing the item from said bottom member, mounted in said U-shaped spring and being configured to place a bottom portion of said item between said second pair of hinge means.

10. The binder of claim 9 wherein said means for spacing the item from said bottom member is a compressible spacer.

11. The binder of claim 8 wherein said means for spacing the item from said bottom member is a compressible spacer mounted in a folder cover in the spring.

12. The binder of claim 8, the plurality of first hinges are movable laterally to said first side of said first cover.

13. The binder of claim 8 wherein individuals of said plurality of U-shaped springs are spaced from one another.

14. A binder comprising a first cover and a second cover, a plurality of U-shaped springs, each of said plurality of U-shaped springs having a top and a bottom and comprising a first arm extending from the bottom to the top and a second arm extending from the bottom to the top, the tops of the first arms and a first side of the first cover forming a first sliding-rotation hinge, the tops of the second arms and a first side of the second cover forming a second sliding-rotation hinge, the bottoms and the first arms and the second arms forming a first channel configured for receiving an item through the first and second hinges when the tops of the arms of the U-shaped springs are moved away from one another.

15. The binder of claim 14, further comprising means for spacing the item from said bottom, mounted in said U-shaped spring and having a height sufficient to place a bottom portion of said item between said second pair of hinge means.

16. The binder of claim 14 wherein individuals of said plurality of U-shaped springs are spaced from one another.

* * * * *